US012760620B2

(12) United States Patent
Brock et al.

(10) Patent No.: US 12,760,620 B2
(45) Date of Patent: Oct. 13, 2026

(54) MULTIPRESSURE CYCLING VALVE FOR A TOE PORT

(71) Applicant: TIER 1 ENERGY SOLUTIONS, INC., Edmonton (CA)

(72) Inventors: Colin Brock, Edmonton (CA); Jeff Skands, Edmonton (CA); Jeffrey Golinowski, Edmonton (CA)

( * ) Notice: Subject to any disclaimer, the term of this patent is extended or adjusted under 35 U.S.C. 154(b) by 112 days.

(21) Appl. No.: 18/889,719

(22) Filed: Sep. 19, 2024

(65) Prior Publication Data

US 2025/0092759 A1 Mar. 20, 2025

Related U.S. Application Data

(60) Provisional application No. 63/583,622, filed on Sep. 19, 2023.

(51) Int. Cl.
*E21B 34/10* (2006.01)

(52) U.S. Cl.
CPC ..... *E21B 34/102* (2013.01)

(58) Field of Classification Search
CPC ..... E21B 34/14; E21B 34/063
See application file for complete search history.

(56) References Cited

U.S. PATENT DOCUMENTS 4,420,044 A * 12/1983 Pullin ..... E21B 23/08 137/71
6,722,439 B2 4/2004 Garay et al.
9,133,684 B2 9/2015 Hofman et al.
9,567,832 B2 2/2017 Hofman et al.
9,915,122 B2 3/2018 Hofman et al.
9,970,264 B2 5/2018 Tulloch
10,344,560 B2 7/2019 Arabsky et al.
10,364,651 B2 7/2019 Stolboushkin et al.
10,487,622 B2 11/2019 Nickles
10,538,991 B2 1/2020 Hofman et al.
10,633,952 B2 4/2020 Passmore
10,794,146 B2 10/2020 Nudo
10,822,919 B2 11/2020 Burris
(Continued)

FOREIGN PATENT DOCUMENTS

CA 2865667 A1 4/2015
CA 2901074 A1 12/2016

*Primary Examiner* — Shane Bomar
(74) *Attorney, Agent, or Firm* — Bennett Jones LLP

(57) ABSTRACT

A multipressure cycling valve includes a top sub adapted to connect to a tubing string and a bottom sub adapted to connect to a toe port device; an outer valve housing connected to the top sub and the bottom sub; a rupture disc body comprising a rupture disc exposed to tubing string fluid pressure; a valve mechanism disposed between the valve housing and an annular valve sleeve, the valve mechanism comprising a plunger moveable from a closed position, to at least one intermediate closed position, to an open position, and an indexing mechanism which advances the plunger from the closed position to the at least one intermediate closed position by a first pressure event, and to the open position by a subsequent pressure event; a biasing means for urging the plunger towards its closed position; and wherein the valve defines a fluid communication path from the rupture disc body, through the plunger and the bottom sub to the toe port device, which fluid communication path is closed by a rupture disc and the plunger when closed.

10 Claims, 9 Drawing Sheets

(56) References Cited

U.S. PATENT DOCUMENTS

| | | | | |
|---|---|---|---|---|
| 12,560,051 | B1 * | 2/2026 | Aljohar | E21B 34/08 |
| 2010/0224371 | A1 * | 9/2010 | Swan | E21B 34/10 166/373 |
| 2012/0085538 | A1 * | 4/2012 | Guerrero | E21B 43/1193 166/284 |
| 2015/0013639 | A1 | 1/2015 | Kohlen et al. | |
| 2015/0136392 | A1 * | 5/2015 | Jackson | E21B 23/006 166/281 |
| 2016/0298420 | A1 * | 10/2016 | Shkurti | E21B 34/063 |
| 2018/0073315 | A1 * | 3/2018 | Date | E21B 21/103 |
| 2019/0128099 | A1 | 5/2019 | Woudwijk | |
| 2019/0292862 | A1 | 9/2019 | O'Brien et al. | |
| 2020/0157916 | A1 | 5/2020 | Hofman et al. | |
| 2020/0157917 | A1 * | 5/2020 | Olguin | E21B 23/006 |
| 2020/0165900 | A1 * | 5/2020 | Roessler | E21B 34/14 |
| 2021/0301614 | A1 | 9/2021 | Nguyen et al. | |

* cited by examiner

POSITION 1 - RUN IN CONFIGURATION

POSITION 2 - PRESSURE CYCLE 1

POSITION 3 - DEPRESSURIZED

POSITION 4 - PRESSURE CYCLE 2

POSITION 5 - DEPRESSURIZED

POSITION 6 - PRESSURE CYCLE 3 / VALVE OPEN

MULTIPRESSURE CYCLING VALVE FOR A TOE PORT

FIELD

The present invention relates to toe ports, also known as toe valves, which permit high flow continuous fluid communication to a hydrocarbon reservoir.

BACKGROUND

Toe ports, also known as toe valves, permit high flow continuous fluid communication to the reservoir, typically for high pressure stimulation or production operations. Toe ports may be opened or actuated with a burst disk or a valve operation, which is responsive to high pressure in the tubing string.

It is sometimes desirable to pressure up a tubing string multiple times before opening the toe port. There is a need in the art for a device to allow for multiple pressure events before allowing tubing pressure to reach and actuate a toe port.

SUMMARY

In one aspect, described herein is a multipressure cycling valve which comprises:

(a) a top sub adapted to connect to a tubing string and a bottom sub adapted to connect to a toe port device;

(b) an outer valve housing connected to the top sub and the bottom sub;

(c) a rupture disc body comprising a rupture disc exposed to tubing string fluid pressure;

(d) a valve mechanism disposed between the valve housing and an annular valve sleeve, the valve mechanism comprising a plunger moveable from a closed position, to at least one intermediate closed position, to an open position, and an indexing mechanism which advances the plunger from the closed position to the at least one intermediate closed position by a first pressure event, and to the open position by a subsequent pressure event;

(e) a biasing means for urging the plunger towards its closed position; and wherein the valve defines a fluid communication path from the rupture disc body, through the plunger and the bottom sub to the toe port device, which fluid communication path is closed by a rupture disc and the plunger when closed.

In one embodiment, the indexing mechanism comprises a J-slot plunger which slides longitudinally within the valve sleeve and which rotates around its longitudinal axis. The J-slot plunger defines an internal flow path. The J-slot plunger engages an immobile J-pin. The J-slot plunger reciprocates in response to sequential pressure events from a closed position, at least one intermediate closed position, and an open position.

In another example, the indexing mechanism comprises a plunger and a ratchet assembly. Sequential pressure events move the plunger and ratchet assembly through the at least one intermediate closed position until the plunger reaches a valve opening position.

In another aspect, described is a method of actuating a toe port, comprising the steps of:

(a) providing an indexable valve in a tubing string above the toe port;

(b) indexing the valve from a closed state to an intermediate closed state with an initial pressure event;

(c) indexing the valve from the intermediate closed state to an open state with a subsequent pressure event.

In some embodiments, the valve may be indexed with multiple pressure cycles through two or more intermediate closed states, before a final pressure event opens the valve.

Further embodiments, forms, features, and aspects of the present application shall become apparent from the description and figures provided herewith. Aspects or embodiments of the invention may include any combination or subcombination or elements, features, means-plus-function, steps, or step-plus-function described or illustrated herein.

BRIEF DESCRIPTION OF THE DRAWINGS

The concepts described herein are illustrative by way of example and not by way of limitation in the accompanying figures. For simplicity and clarity of illustration, elements illustrated in the figures are not necessarily drawn to scale. Where considered appropriate, references labels have been repeated among the figures to indicate corresponding or analogous elements.

(a)

(b)

(c)

(d)

(e)

(f)

(g)

(h)

(i)

(j)

(k)

(l)

(m)

DETAILED DESCRIPTION

Figure 1A:
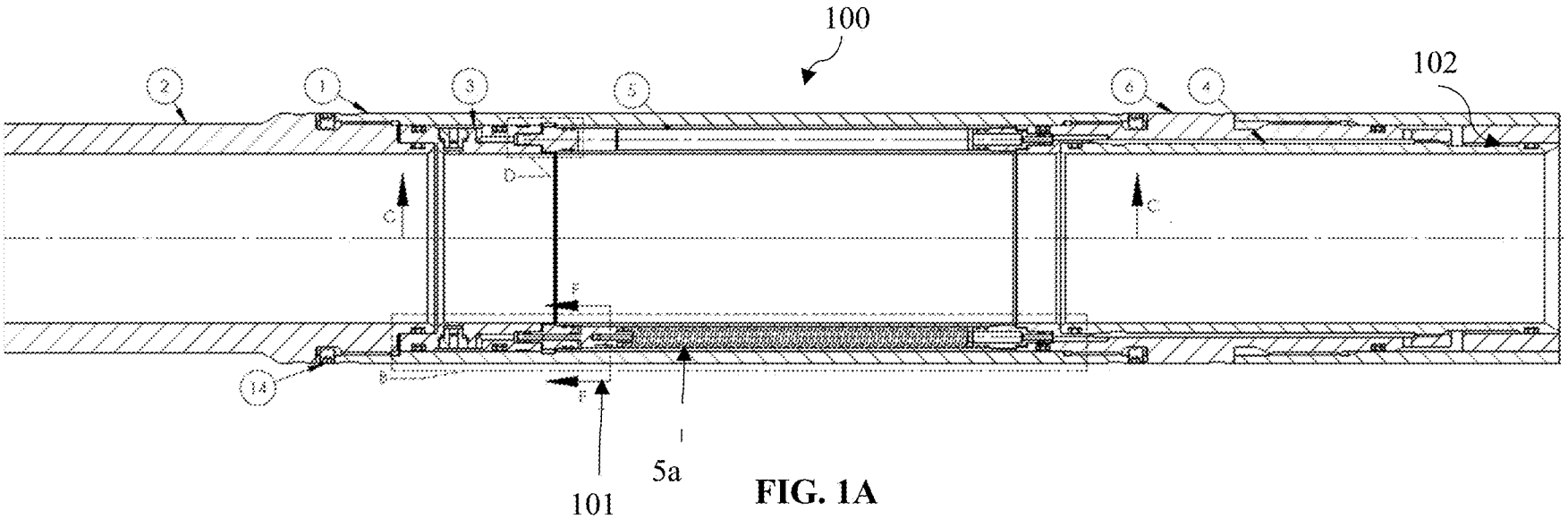
FIG. 1A is a longitudinal cross-section of one embodiment of a multipressure cycling valve.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described. Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may not be included or may be combined with other features.

The terms longitudinal, lateral, and transverse may be used to denote motion or spacing along three mutually perpendicular axes, wherein each of the axes defines two opposite directions. The directions defined by each axis may also be referred to as positive and negative directions. Additionally, the descriptions that follow may refer to the directions defined by the axes with specific reference to the orientations illustrated in the figures. For example, the directions may be referred to as distal/proximal, left/right, and/or up/down. It should be appreciated that such terms may be used simply for ease and convenience of description and, therefore, used without limiting the orientation of the system with respect to the environment unless stated expressly to the contrary. For example, descriptions that reference a longitudinal direction may be equally applicable to a vertical direction, a horizontal direction, or an off-axis orientation with respect to the environment. Furthermore, motion or spacing along a direction defined by one of the axes need not preclude motion or spacing along a direction defined by another of the axes. For example, elements described as being "laterally offset" from one another may also be offset in the longitudinal and/or transverse directions, or may be aligned in the longitudinal and/or transverse directions. The terms are therefore not to be construed as further limiting the scope of the subject matter described herein.

A multicycle toe valve device 100 is described herein with reference to the drawings which show a longitudinal axis of the device in a horizontal position. In these drawings, the upper end of the device is on the left, while the lower end is on the right. Upper and lower refer to the orientation of the device when it is inserted into a wellbore. The lower end is inserted first.

Referring now to FIG. 1A, in one illustrative embodiment, a multicycle toe valve device 100 comprises a valve housing 1 and a top sub 2 adapted to connect the device into the tubing string (not shown), for example by a threaded connection. A valve mechanism 101 is disposed within the upper valve housing 1 and comprises a rupture disc body 3 and a valve sleeve 5 which defines a valve space 5*a*. A lower valve housing 6 is connected to a lower end of the upper valve housing 1, and is adapted to connect to an upper end of a toe port device 102. An annular space defining a flow path is defined between the lower valve housing 6 and an internal seal sleeve 4.

The valve mechanism 101 functions to index a valve with at least one pressure event during which event the valve remains closed. A subsequent, final pressure event then opens the valve, which allows for pressure actuation of the toe port device 102. As used herein, a "pressure event" is fluid pressure being exerted in the tubing string which pressure acts on the valve mechanism. The indexing function is provided by an indexing mechanism. In one embodiment, the indexing mechanism comprises a mechanical ratcheting mechanism. In another embodiment, the indexing mechanism comprises an indexing slot mechanism, which is referred to herein as a "J-slot" indexer.

Figure 1C:
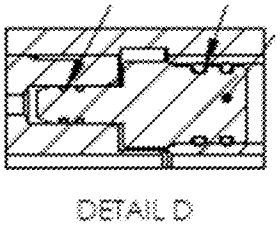
FIG. 1C is an expanded portion showing detail D of FIG. 1A.
Figure 1B:
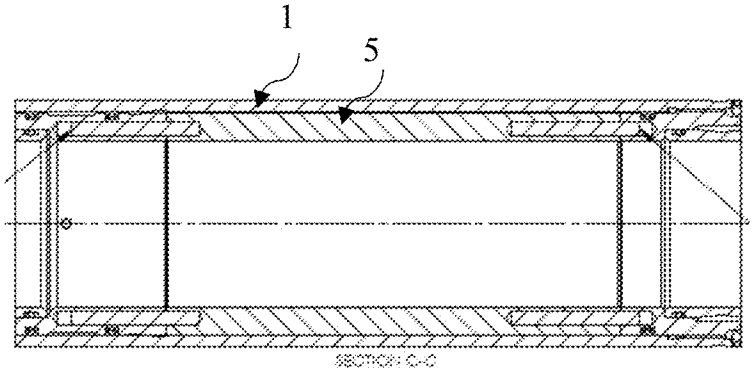
FIG. 1B is a cross-section through a plane perpendicular to that of FIG. 1A.

On the opposing side of the valve housing, another valve mechanism may be installed, or a blanking plug may be used seal up the passage, as shown in detail D and FIG. 1C.

J-Slot Indexing

Referring to FIGS. 1-6, in some embodiments, the valve mechanism 101 comprises a rupture disc body 3 which comprises a rupture disc 3*a* and defines an internal bore. The rupture disc serves to isolate the valve mechanism from pressure events which are not intended to activate or index the valve. Any pressure below the burst strength of the rupture disc will not affect the valve mechanism. In alternative embodiments, the rupture disc 3*a* may be replaced with any suitable valve having a threshold opening capacity.

A valve cap 7 has a pin 7*a* which inserts into and is sealed to the rupture disc body internal bore with O-rings 22. The valve cap 7 also has an internal bore which forms a flow path with the rupture disc body internal bore. The valve cap 7 bears on a shoulder formed by the valve sleeve 5, which restrains the valve cap 7 from moving downwards, maintaining the valve cap pin 7*a* within the rupture disc body 3.

A cylindrical J-slot plunger 8 is disposed below the valve cap 7, and has a pin 8*a* which inserts into and is sealed to the valve cap internal bore with O-rings 24. The J-slot plunger 8 slides longitudinally within the valve sleeve 5 and also rotates around its longitudinal axis. The J-slot plunger defines an internal flow path defined by an upper offset bore open to valve chamber above the plunger 8 and a lower central bore open to the valve chamber below the plunger 8, the upper offset bore and the lower central bore connected by at least one transverse port 8*c*.

Figure 2:
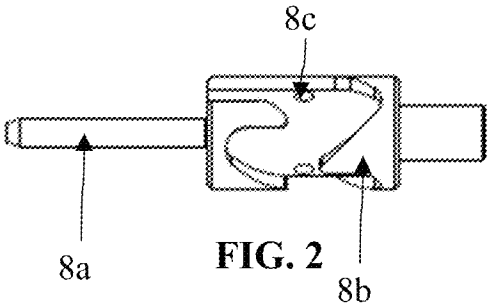
FIG. 2 is a view of a J-slot plunger of the embodiment of FIG. 1.
Figure 4:
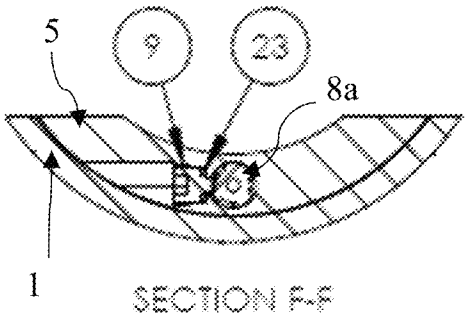
FIG. 4 is a transverse cross-section of a portion of FIG. 1, along line F-F.
Figure 3:
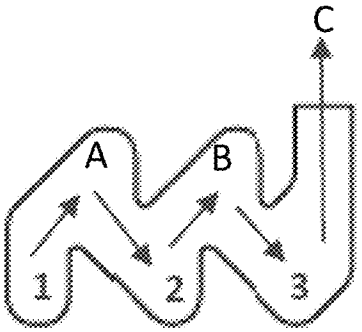
FIG. 3 is two-dimensional representation of the J-slot defined by the J-slot plunger of FIG. 2.
Figure 5:
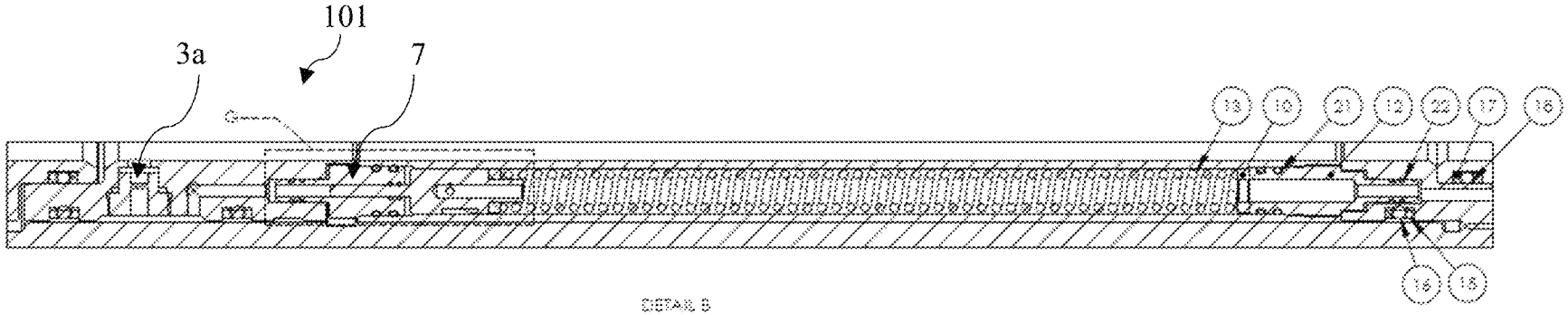
FIG. 5 is an expanded portion showing detail B of FIG. 1.
Figure 6:
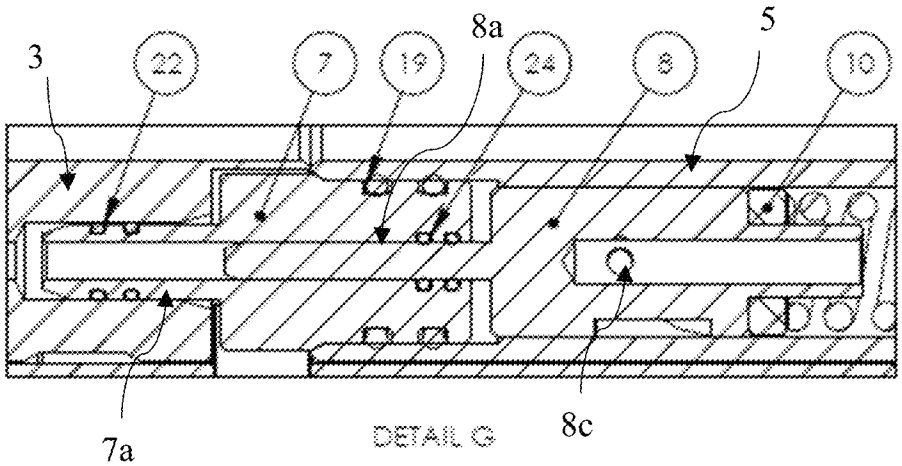
FIG. 6 is an expanded portion showing detail G of FIG. 5.
Figure 7A:
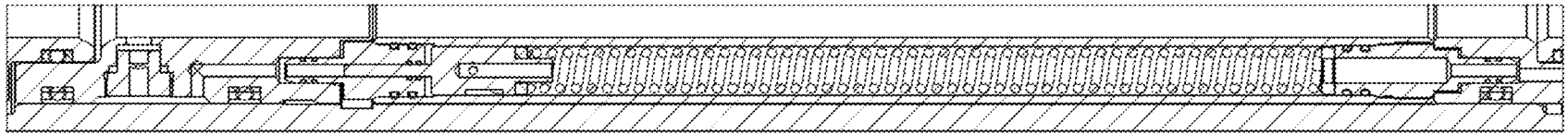
FIGS. 7A, 7B and 7C show the detail of FIG. 5 in a run-in configuration, at a first pressure cycle position, and a depressurized configuration, respectively.
Figure 7B:
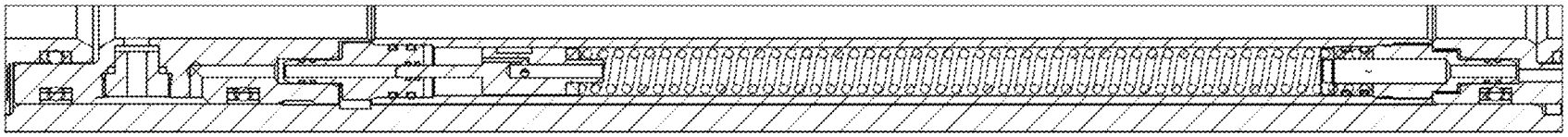
Figure 7C:
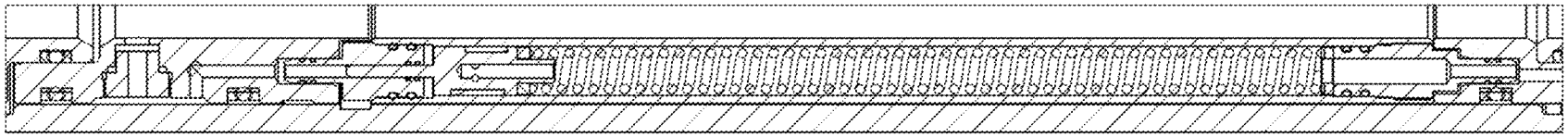
Figure 8A:
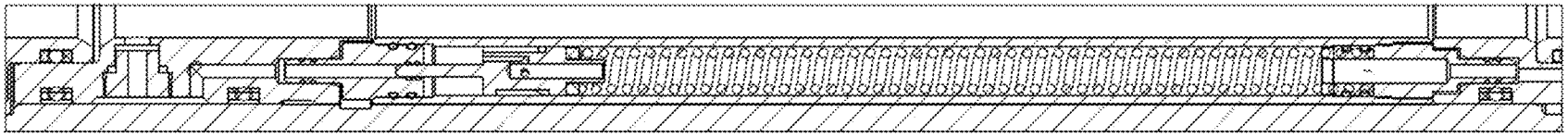
FIGS. 8A, 8B and 8C show the detail of FIG. 5 in a second pressure cycle configuration, a second depressurized configuration, and a third pressure cycle (valve open) configuration.
Figure 8B:
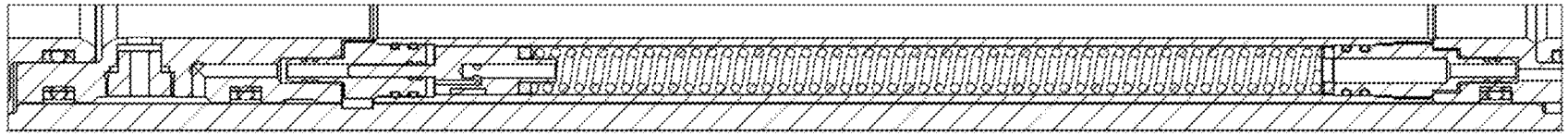
Figure 8C:
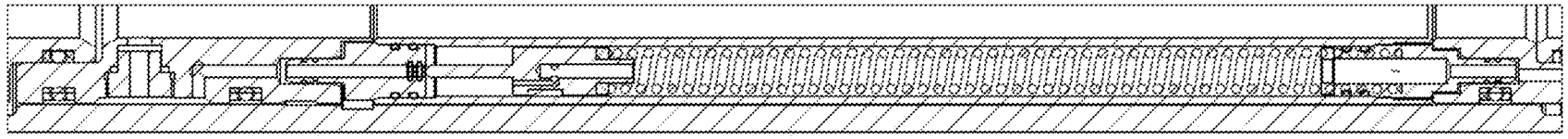
Figure 9A:
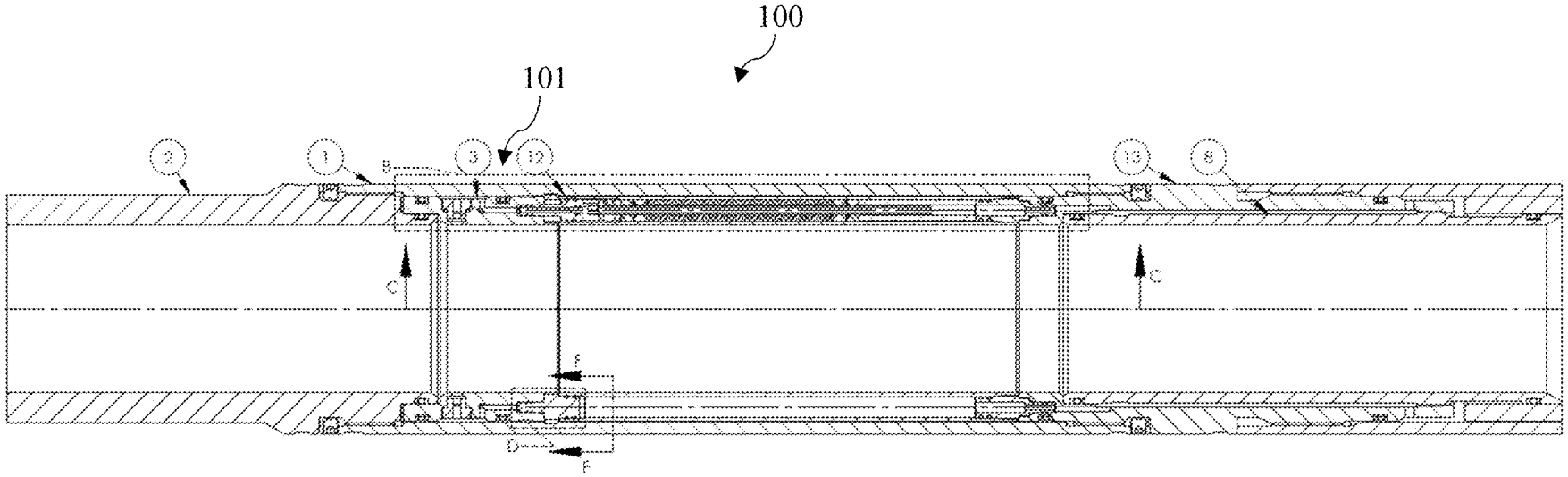
FIG. 9A is a longitudinal cross-section of an alternative embodiment of a multipressure cycling valve using a ratcheting mechanism.
Figure 9B:
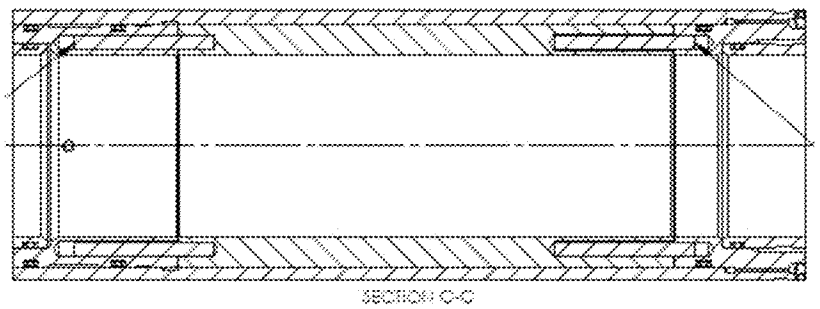
FIG. 9B is a cross-section through a plane perpendicular to that of FIG. 9A.
Figure 9C:
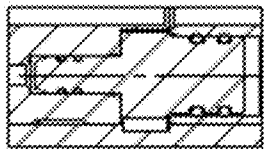
FIG. 9C is an expanded portion showing detail D of FIG. 1A.
Figure 10:
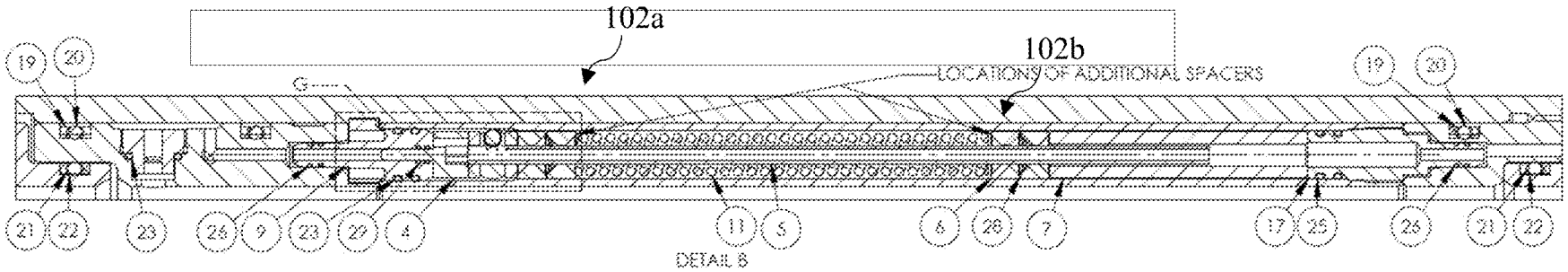
FIG. 10 is an expanded portion showing detail B of FIG. 9.

As shown in FIG. 2, one embodiment of the J-slot plunger body 8 has a plunger body 8*b* having a circumferential surface which defines the J-slot, which is a slot defining a path between pressure positions A, B, C, and depressurized positions 1, 2, 3, as shown in FIG. 3, which shows the J-slot path in 2-dimensions. The J-slot engages an immobile J-pin 9 affixed to the valve sleeve 5, which extends transversely into the J-slot, as may be seen in FIG. 4. As the J-slot plunger 8 moves longitudinally, the J-pin 9 travels within the J-slot and causes the plunger 8 to rotate around its longitudinal axis. A biasing means, for example a coil spring 13, is positioned within the valve chamber 5*a* and urges the plunger 8 upwards. The pressure in the valve chamber below the plunger is atmospheric gas pressure. Spring spacers 10 may be provided to increase the spring-preload, and thus vary the force necessary to compress the spring.

FIG. 3 shows one embodiment of a J-slot in a 2-dimensional view, which is configured to allow two pressure events, before a third pressure event opens the valve. The J-pin 9 starts in position (1) in the slot. A first pressure event ruptures the rupture disc and exposes the internal bore of the valve cap 7 to the tubing pressure. As the J-slot plunger pin 8*a* is sealed by O-rings within the internal bore, the J-slot plunger 8 is pushed downwards until the J-pin reaches pressure position (A), which is an intermediate closed position. The pressure at which plunger movement may be initiated is governed first by the burst pressure rating of the rupture disc, and secondly by the strength of coil spring 13. When the pressure in the tubing string is reduced, the spring 13 urges the plunger 8 back upwards, and the J-pin will move to depressurized position (2). A second pressure event will then move the J-pin 9 to pressure position (B). The plunger pin 8*a* is still sealed within the valve cap 7 in pressure positions (A) and (B) and no fluid may flow past the valve cap 7. Depressurization will again allow the J-pin to move to depressurized position (3). A third and final pressure event will then allow the J-slot plunger 8 to move free of the J-pin 9 into position (C), where the plunger pin 8*a* moves out of the valve cap 7, whereupon the valve assembly will open.

The J-slot plunger opens when the J-slot plunger pin 8*a* moves clear of the seals 24 in the valve cap 7 bore, creating a fluid communication path through the J-slot 8 and transverse ports 8*c*, into the valve chamber 5*a* below. The fluid communication path continues to the lower end of the device 100, into the lower valve housing 6 and the toe port device (not shown). Thus a pressure communication path is opened to the toe port device, allowing for the pressure-activated opening of the toe port.

The number of pressure events which result in the valve opening is determined by the configuration of the J-slot.

Ratcheting Mechanism

In this section describing an alternative embodiment, reference numbers refer to those numbers in FIGS. 9-13. In an alternative embodiment, the device 100 comprises an upper valve housing 1, top sub 2, rupture disc body 3 having a rupture disc, valve cap 9, and seal sleeve 8 in similar manner as the J-slot embodiment described above. A valve sleeve 12 is disposed within the upper valve housing 1, and defines a valve chamber which houses the valve assembly 101.

A plunger 4 and a ratchet rod 5 cooperate within the valve sleeve 1 as described below. The plunger 4 defines a plunger pin 4*a* which inserts into and is sealed within the valve cap 9 internal bore. The plunger 4 also defines an axial internal flow path 4*b* which is offset from the central axis of the plunger and closed when the plunger 4 is in contact with the valve cap 9. The plunger 4 bears on a top end of the ratchet rod 5 which moves longitudinally. The bottom end of the ratchet rod 5 inserts into a rod spacer 7 which guides and centralizes the ratchet rod 5 through its longitudinal movement. The top end of the ratchet rod defines a lower stop for the plunger 4.

The ratchet rod 5 slides within a ratchet assembly 102 comprising a spring 11, spring spacers 10, push nut spacers 6, and upper and lower push nuts 28*a*, 28*b*. The push nuts have an inner diameter in contact with the ratchet rod 5, and an angled edge or teeth which permits downward movement of the ratchet rod 5 through the push nuts, but bites into the surface of the ratchet rod 5 to prevent upwards movement. A lower set of push nut spacers and the lower push nut 28*b* are provided at a lower end of the ratchet rod, adjacent the rod spacer 7.

As may be seen, downward movement of the plunger 4 causes downward movement of the ratchet rod 5 as the plunger bears on the top of the ratchet rod. The upper ratchet assembly 102*a* comprising spring spacers 10, push nut spacers 6 and upper push nut 28*a* move in unison. When the plunger moves back upwards, the upper ratchet assembly is urged back upwards by action of spring 11, but the ratchet rod 5 is retained in a lowered position by the lower ratchet assembly 102*b* and specifically lower push nut 28*b*.

Figure 11:
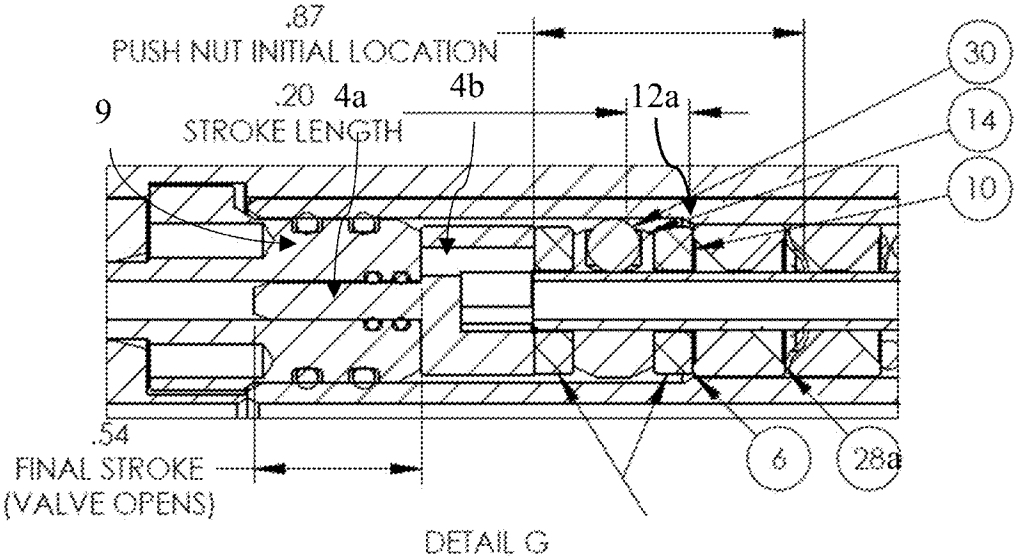
FIG. 11 is an expanded portion showing detail G of FIG. 10.

An upper portion of the valve sleeve 12 has a slightly enlarged inside diameter and a shoulder 12*a* defining a transition to a lower portion which has a slightly reduced inside diameter, illustrated in FIG. 11. A ball 30 is provided in a ball carrier 14, which ball 30 allows movement of the ratchet assembly, but with a travel stop when the ball contacts the valve sleeve shoulder 12*a*. The travel stop prevents the plunger pin 4*a* from exiting the valve cap 9 inner bore. Radially inward movement of the ball 30 is prevented by contact with the ratchet rod 5.

Figure 12A:
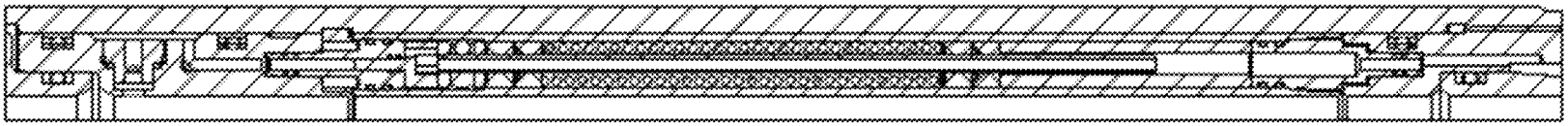
FIGS. 12A, 12B and 12C show the detail of FIG. 10 in a run-in configuration, at a first pressure cycle configuration, and a depressurized configuration, respectively.
Figure 12B:
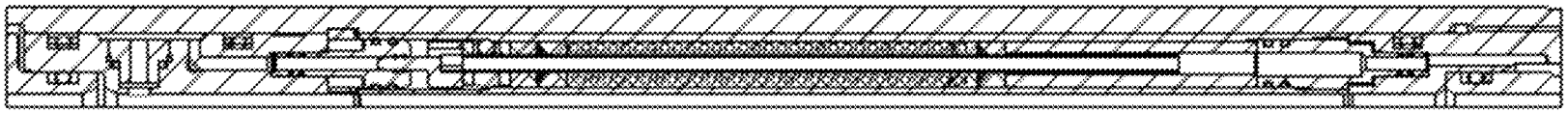
Figure 12C:
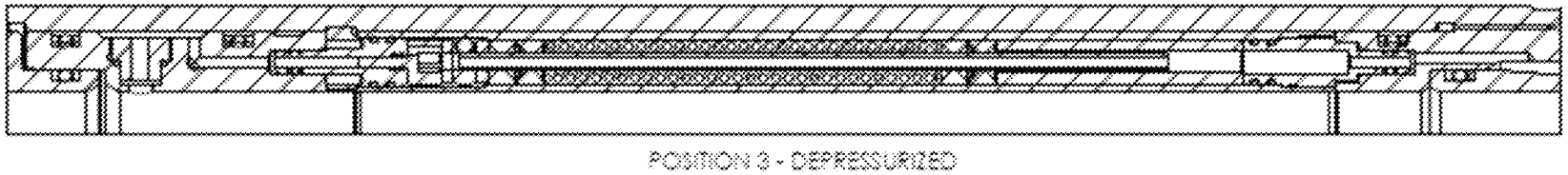
Figure 13A:
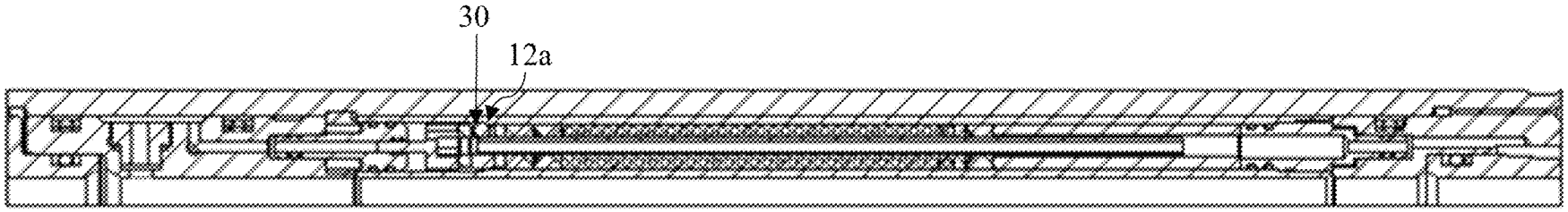
FIGS. 13A, 13B and 13C show the detail of FIG. 10 in a second pressure cycle configuration, a second depressurized configuration, and a third pressure cycle (valve open) configuration.
Figure 13B:
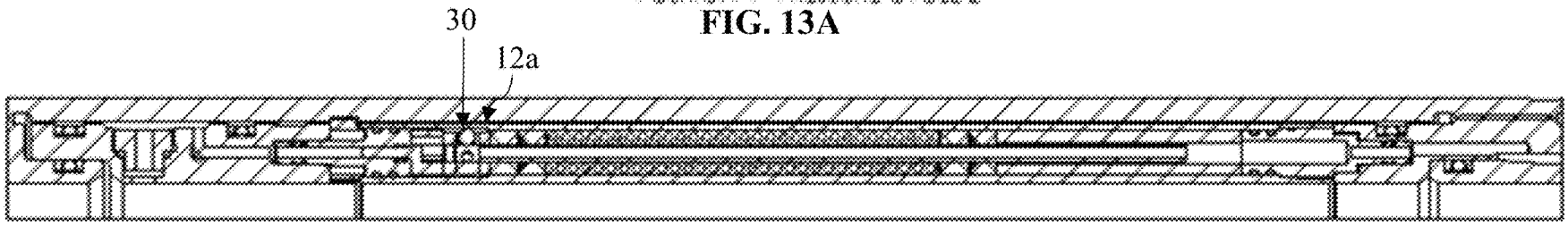
Figure 13C:
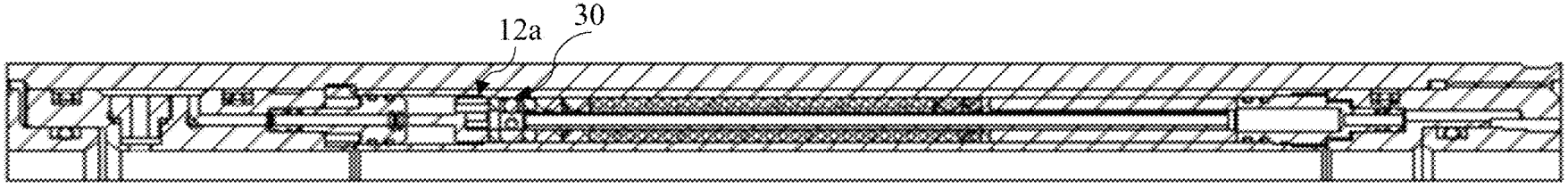

In its run-in configuration, the plunger 4, the ratchet assembly 102 and ratchet rod 5 are in their raised, upper position, as seen in FIG. 12A. A first pressure event ruptures the rupture disc 3*a* and exposes the internal bore of the valve cap 7 to the tubing pressure. As the valve cap is sealed to the rupture disc body 3 with O-rings 26, and the plunger pin 4*a* is sealed by O-rings 23 within the internal bore of the valve cap, the plunger 4 and ratchet assembly 102 are pushed downwards until the stopper ball 30 reaches the shoulder stop 12*a* within the valve sleeve 12. The ratchet rod 5 is also pushed downward by the plunger 4.

The pressure at which plunger movement may be initiated is governed first by the burst pressure rating of the rupture disc 3*a*, and secondly by the strength of coil spring 11. The pre-load on the spring 11 may be varied by the number and size of the spring spacers 10.

When the pressure in the tubing string is reduced to below the strength of the spring 11, the spring 11 urges the plunger 4 and ratchet assembly 102 back upwards, while the ratchet rod 5 is retained in a first intermediate closed position by lower push nut 28*b*. A second pressure event will then repeat the ratcheting motion of the plunger 4, ratcheting assembly 102 and ratchet rod 5, and depressurization will again allow the plunger and ratchet assembly to move back upwards, leaving the ratchet rod in the lowered position (second intermediate closed position).

A third pressure event repeats the ratcheting motion, however, the top end of the ratchet rod 5 will then be positioned below the stopper ball 30, in a valve opening position. The stopper ball 30 may then move radially inward, allowing downward travel of the plunger below the travel stop. As may be seen, the plunger has an OD which allows it to slide within the ID of valve sleeve 12 below shoulder 12*a*.

In the valve opening position, the plunger pin 4*a* is thus freed from the valve cap inner bore. Fluid pressure may then be communicated across the plunger through port 4*b* and downward into the valve chamber below. The fluid communication path continues to the lower end of the device 100, into the lower valve housing 13 and the toe port device (not shown). Thus a pressure communication path is opened to the toe port device, allowing for the pressure-activated opening of the toe port.

The number of pressure events which result in the valve opening may be varied by the length of stroke caused by each pressure event, and the relative position of the stopper ball 30 and the shoulder stop 12*a*.

The invention claimed is:

1. A multipressure cycling valve comprising:

(a) a top sub adapted to connect to a tubing string and a bottom sub adapted to connect to a toe port device;

(b) an outer valve housing connected to the top sub and the bottom sub;

(c) a rupture disc body comprising a rupture disc exposed to tubing string fluid pressure;

(d) valve mechanism disposed between the valve housing and an annular valve sleeve, the valve mechanism comprising a plunger moveable from a closed position, to at least one intermediate closed position, to an open position, and an indexing mechanism which advances the plunger from the closed position to the at least one intermediate closed position by a first pressure event and to the open position by a subsequent pressure event;

(e) a biasing means for urging the plunger towards its closed position; and wherein the valve defines a fluid communication path from the rupture disc body, through the plunger and the bottom sub to the toe port device, which fluid communication path is closed by a rupture disc and the plunger when closed;

wherein the indexing mechanism comprises:

(a) a J-slot plunger which slides longitudinally within the valve sleeve and which rotates around its longitudinal axis, and which defines an internal flow path and an external J-slot in the plunger cylindrical surface; and (b) an immobile and transverse J-pin affixed to the valve sleeve which engages the J-slot;

wherein longitudinal movement of the J-slot plunger in response to the pressure events causes rotation and reciprocation of the plunger from a closed position, to the at least one intermediate closed position, and to the open position.

2. The valve of claim 1 wherein the plunger is moveable from a first intermediate closed position to a second intermediate closed position by a second pressure event.

3. The valve of claim 1 wherein the biasing means comprises a coil spring and, optionally, at least one spring spacer.

4. A multipressure cycling valve comprising:

(a) a top sub adapted to connect to a tubing string and a bottom sub adapted to connect to a toe port device;

(b) an outer valve housing connected to a tub sub and the bottom sub;

(c) a rupture disc body comprising a rupture disc exposed to tubing string fluid pressure;

a valve mechanism disposed between the valve housing an annular valve sleeve, the valve mechanism comprising a plunger moveable from a closed position, to at least one intermediate closed position, to an open position, and an indexing mechanism which advances the plunger from the closed position to the at least one intermediate closed position by a first pressure event, and to the open position by a subsequent pressure event;

(e) a biasing means for urging the plunger towards its closed position; and wherein the valve defines a fluid communication path from the rupture disc body, through the plunger and the bottom sub to the toe port device, which fluid communication path is closed by a rupture disc and the plunger when closed;

wherein the indexing mechanism comprises a ratchet assembly comprising a ratchet rod, an upper push nut and a lower push nut, wherein the plunger bears on a top end of the ratchet rod, and wherein each of the push nuts engages the ratchet rod to permit downward movement of the ratchet rod while restricting upward movement, wherein longitudinal movement of the plunger and ratchet rod in response to pressure events causes movement of the plunger from the closed position, through the at least one intermediate closed position, and to the open position.

5. The valve of claim 4 wherein the plunger is moveable from a first intermediate closed position to a second intermediate closed position.

6. The valve of claim 5 wherein the biasing means comprises a coil spring and, optionally, at least one spring spacer.

7. A method of actuating a toe port using the valve of claim 1, comprising the steps of:

(a) installing the valve in a tubing string above the toe port;

(b) indexing the valve from a closed state to an intermediate closed state with an initial pressure event;

(c) indexing the valve from the intermediate closed state to an open state with a subsequent pressure event, wherein fluid flow through the open valve actuates the toe port.

8. The method of claim 7, wherein the valve is indexed with multiple pressure cycles through two or more intermediate closed states, before a final pressure event opens the valve.

9. A method of actuating a toe port using the valve of claim 4, comprising the steps of:

(a) installing the valve in a tubing string above the toe port;

(b) indexing the valve from a closed state to an intermediate closed state with an initial pressure event;

(c) indexing the valve from the intermediate closed state to an open state with a subsequent pressure event, wherein fluid flow through the open valve actuates the toe port.

10. The method of claim 9, wherein the valve is indexed with multiple pressure cycles through two or more intermediate closed states, before a final pressure event opens the valve.

* * * * *